US009964316B2

(12) United States Patent
Deivasigamani et al.

(10) Patent No.: US 9,964,316 B2
(45) Date of Patent: May 8, 2018

(54) WEATHER FORECAST AND PREDICTION BASED TEMPERATURE CONTROL

(71) Applicants: Sridhar Deivasigamani, Peoria, IL (US); Sivaprasad Akasam, Dunlap, IL (US)

(72) Inventors: Sridhar Deivasigamani, Peoria, IL (US); Sivaprasad Akasam, Dunlap, IL (US)

(73) Assignee: Intellihot, Inc., Galesburg, IL (US)

( * ) Notice: Subject to any disclaimer, the term of this patent is extended or adjusted under 35 U.S.C. 154(b) by 245 days.

(21) Appl. No.: 14/969,583

(22) Filed: Dec. 15, 2015

(65) Prior Publication Data

US 2016/0169539 A1 Jun. 16, 2016

Related U.S. Application Data

(60) Provisional application No. 62/091,809, filed on Dec. 15, 2014.

(51) Int. Cl.
*F24D 19/10* (2006.01)
*F24H 9/20* (2006.01)
*F24D 17/00* (2006.01)

(52) U.S. Cl.
CPC ..... *F24D 19/1009* (2013.01); *F24D 19/1069* (2013.01); *F24H 9/2007* (2013.01); *F24D 19/1051* (2013.01)

(58) Field of Classification Search
CPC ..... F24D 19/1009; F24D 19/1069; F24D 19/1051; F24D 17/0026; F24H 9/2007
USPC ..... 237/12, 2 A, 81, 8 A; 122/446, 14.21
See application file for complete search history.

(56) References Cited

U.S. PATENT DOCUMENTS 4,775,944 A 10/1988 Nakamura
4,921,163 A * 5/1990 Viessmann ..... F24D 19/1009 236/46 R
6,098,893 A 8/2000 Berglund et al.
6,591,901 B2 * 7/2003 Bujak, Jr. ..... F24F 3/06 165/208
6,644,398 B2 * 11/2003 Bujak, Jr. ..... F24F 3/06 165/208
8,140,193 B2 * 3/2012 Lee ..... G05D 23/19 700/286

(Continued)

OTHER PUBLICATIONS

"Web—Weather Oct. 16, 2017.pdf", Weather forecast for Oct. 16, 2017, https://www.timeanddate.com, Oct. 16, 2017.*

(Continued)

*Primary Examiner* — Gregory Huson
*Assistant Examiner* — Daniel E Namay
(74) *Attorney, Agent, or Firm* — Tracy Jong Law Firm; Tracy P. Jong; Cheng Ning Jong

(57) ABSTRACT

A weather forecast-based fluid heating control system having at least one hot fluid delivery point, the control system including a controller adapted to control a fluid supply to a setpoint temperature, a means for obtaining the forecasted air temperature at a future time of the location of the control system and a means for obtaining the current air temperature at a current time of the location of the control system. The setpoint temperature of the fluid supply is adjusted by an adjustment amount if the difference between the forecasted air temperature of the location of the control system and the current temperature at the current time of the location of the control system exceeds a pre-determined threshold.

19 Claims, 3 Drawing Sheets

(56) References Cited

U.S. PATENT DOCUMENTS 8,224,495 B2 * 7/2012 Weaver ..... F01K 3/16 137/828
8,543,244 B2 9/2013 Keeling
8,636,226 B2 * 1/2014 Paulus ..... F24D 19/1048 122/16.1
8,843,239 B2 * 9/2014 Mighdoll ..... F24F 11/0012 236/91 D
8,851,393 B1 * 10/2014 Girgis ..... G05D 23/1902 236/91 D
9,279,595 B2 * 3/2016 Mighdoll ..... F24F 11/0012
9,410,752 B2 * 8/2016 Wallace ..... F28F 27/00
9,719,687 B2 * 8/2017 Deivasigamani ... F24D 19/1069
2011/0172830 A1 * 7/2011 Milder ..... F24D 19/1009 700/277
2012/0239221 A1 * 9/2012 Mighdoll ..... F24F 11/0012 700/300
2012/0259470 A1 * 10/2012 Nijhawan ..... G05D 23/1934 700/278
2013/0231792 A1 * 9/2013 Ji ..... G05B 19/02 700/291
2013/0310989 A1 * 11/2013 Steinberg ..... F24F 11/006 700/278
2014/0048244 A1 * 2/2014 Wallace ..... F28F 27/00 165/253
2014/0067132 A1 * 3/2014 Macek ..... F24F 11/006 700/276
2015/0057814 A1 * 2/2015 Mighdoll ..... F24F 11/0012 700/278
2015/0204550 A1 * 7/2015 Deivasigamani ... F24D 19/1069 237/2 A
2015/0276237 A1 * 10/2015 Daniels ..... F24D 19/10 237/2 A
2015/0276239 A1 * 10/2015 Fadell ..... G05D 23/1905 237/2 A
2015/0300660 A1 * 10/2015 Kim ..... F24H 9/2035 237/8 A
2016/0313020 A1 * 10/2016 Wallace ..... F28F 27/00
2017/0248325 A1 * 8/2017 Deivasigamani ... F24D 19/1069

OTHER PUBLICATIONS

"Web—Weather Aug. 2014.pdf", Weather forecast for Aug. 2014, https://www.timeanddate.com, Oct. 16, 2017.*
"Web—Weather Jan. 2014.pdf", Weather forecast for Jan. 2014, https://www.timeanddate.com, Oct. 16, 2017.*

* cited by examiner

WEATHER FORECAST AND PREDICTION BASED TEMPERATURE CONTROL

PRIORITY CLAIM AND RELATED APPLICATIONS

This non-provisional application claims the benefit of priority from provisional application U.S. Ser. No. 62/091,809 filed Dec. 15, 2014. Said application is incorporated by reference in its entirety.

BACKGROUND OF THE INVENTION

1. The Field of the Invention

The present invention is directed generally to a prediction based temperature control mechanism. More specifically, the present invention is directed to a weather forecast and prediction based temperature control mechanism for water heaters.

2. Background Art

Control mechanisms for space heating and cooling devices based on weather forecast data have been previously attempted in the space heating arena, such as those disclosed in the following disclosures.

U.S. Pat. No. 6,098,893 to Berglund et al. (hereinafter Berglund) discloses a weather forecast unit capable of sending weather forecast data over the Internet to a building management provider which handles building management services for a number of clients, each having a number of buildings and properties. At the provider's reception station, data on the external-building characteristics of all the buildings are compiled with the received data and then fed to the appropriate building management controls system. Berglund discloses a means to combine weather forecast data with a group of external-building characteristics relating to at least one building to derive instructions signals for comfort controls operation of the at least one building. Berglund does not disclose comfort controls related to water heating.

U.S. Pat. No. 4,775,944 to Nakamura et al. (hereinafter Nakamura) discloses a control system for air conditioning and/or hot water supplying apparatus using a central heat source that supplies cooling or heating to a plurality of dwelling units of a congregated or multi-storied house. The system calculates the optimum operating condition of the air conditioning and/or hot water supplying apparatus in each of the dwelling units using the operating state information of the central heat source, the weather information forecasted on the basis of the outdoor weather information, the indoor atmosphere information, and the operating state of the air conditioning and/or hot water supplying apparatus in the dwelling units, and the optimum condition is displayed on an output terminal device in each of the dwelling units. Nakamura discloses a central heat source without specifying in detail how this central heat source affects the control of a hot water supplying apparatus.

U.S. Pat. No. 8,543,244 to Keeling et al. (hereinafter Keeling) discloses a controller that integrates the control of heating or cooling in buildings by simultaneously controlling heating, ventilation and cooling systems in concert with separate fresh air ventilation systems by reacting to outside and inside conditions, wherein the controller additionally utilizes a local weather forecasting data retrieval system provided over an internet connection wherein the controller uses weather forecasting data from the local weather forecasting data retrieval system to optimize algorithms for improved setpoints for fresh air ventilation or heating, ventilation and air conditioning control. Keeling does not disclose controls of devices related to water heating.

The Applicants discovered a correlation between the outdoor weather and the domestic water temperature as it is related to the comfort experienced by a user. None of these and other weather forecast based control systems are adapted to control water heaters. Thus, there is a need for a water, e.g., domestic water, heating system capable of controlling the operation of the water heating system, e.g., by adjusting its setpoint temperature based on current and forecasted outdoor temperature and capable of adjusting its setpoint temperature automatically and in anticipation of upcoming weather events.

SUMMARY OF THE INVENTION

In accordance with the present invention, there is provided a fluid heating control system having at least one hot fluid delivery point disposed at a location, the fluid heating control system including:

(a) a controller adapted to control the fluid heating control system to a setpoint temperature of the at least one hot fluid delivery point;

(b) a means for obtaining a forecasted air temperature at a future time at the location of the fluid heating control system; and (c) a means for obtaining a current air temperature at a current time at the location of the fluid heating control system, whereby the setpoint temperature of the at least one hot fluid delivery point is configured to be adjusted by an adjustment amount if the difference between the forecasted air temperature at the future time at the location of the fluid heating control system and the current temperature at the current time at the location of the fluid heating control system exceeds a pre-determined threshold.

In one embodiment, the pre-determined threshold is about 2 degrees F. In another embodiment, the pre-determined threshold is about 5 degrees F.

In one embodiment, the adjustment amount is about 1 degree F. In another embodiment, the adjustment amount is about 2 degrees F.

In one embodiment, the location of the fluid heating control system is obtained as a zip code via a pre-programmed code. In another embodiment, the location of the fluid heating control system is obtained as a zip code via a Domain Name Service (DNS) derived zip code.

In one embodiment, the difference between the future time and the current time is about an hour. At this interval, the outdoor temperature can be accurately predicted, making any adjustments made valid for the control system.

In one embodiment, the fluid heating control system further includes a means for obtaining a forecasted wind chill factor at a future time at the location of the fluid heating control system and a means for obtaining a current wind chill factor at a current time at the location of the fluid heating control system, wherein a difference of the forecasted wind chill factor and the current wind chill factor is configured to be applied to the adjustment of the setpoint temperature of the at least one hot fluid delivery point.

In one embodiment, the fluid heating control system further includes a means for obtaining a forecasted heat index at a future time at the location of the fluid heating control system and a means for obtaining a current heat index at a current time at the location of the fluid heating control system, wherein a difference of the forecasted heat index and the current heat index is configured to be applied to the adjustment of the setpoint temperature of the at least one hot fluid delivery point.

An object of the present invention is to provide a means for adjusting a hot water heater's setpoint temperature automatically.

Another object of the present invention is to provide a means for adjusting a hot water heater's setpoint temperature based on weather forecast data, thereby providing adjustment of the hot water heater setpoint temperature to anticipate a weather change event, enabling the hot water heater to anticipate and meet the need for comfort of a user.

Whereas there may be many embodiments of the present invention, each embodiment may meet one or more of the foregoing recited objects in any combination. It is not intended that each embodiment will necessarily meet each objective. Thus, having broadly outlined the more important features of the present invention in order that the detailed description thereof may be better understood, and that the present contribution to the art may be better appreciated, there are, of course, additional features of the present invention that will be described herein and will form a part of the subject matter of this specification.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

PARTS LIST

2—step of determining forecasted weather data
4—step of comparing forecast temperature and current temperature
6—controller
8—zip code input
10—setpoint temperature input
12—heating temperature input
14—heating element
16—outdoor ambient temperature sensor
18—internet
20—weather forecast data

PARTICULAR ADVANTAGES OF THE INVENTION

The present water heating control system automatically adjusts its setpoint temperature to suit the outdoor environment in which the water heating control system operates in, removing the need for a user who is already accustomed to the temperature settings of the delivery points of the water heating system to make adjustments to suit the user's needs.

DETAILED DESCRIPTION OF A PREFERRED EMBODIMENT

The term "about" is used herein to mean approximately, roughly, around, or in the region of. When the term "about" is used in conjunction with a numerical range, it modifies that range by extending the boundaries above and below the numerical values set forth. In general, the term "about" is used herein to modify a numerical value above and below the stated value by a variance of 20 percent up or down (higher or lower).

Figure 1:
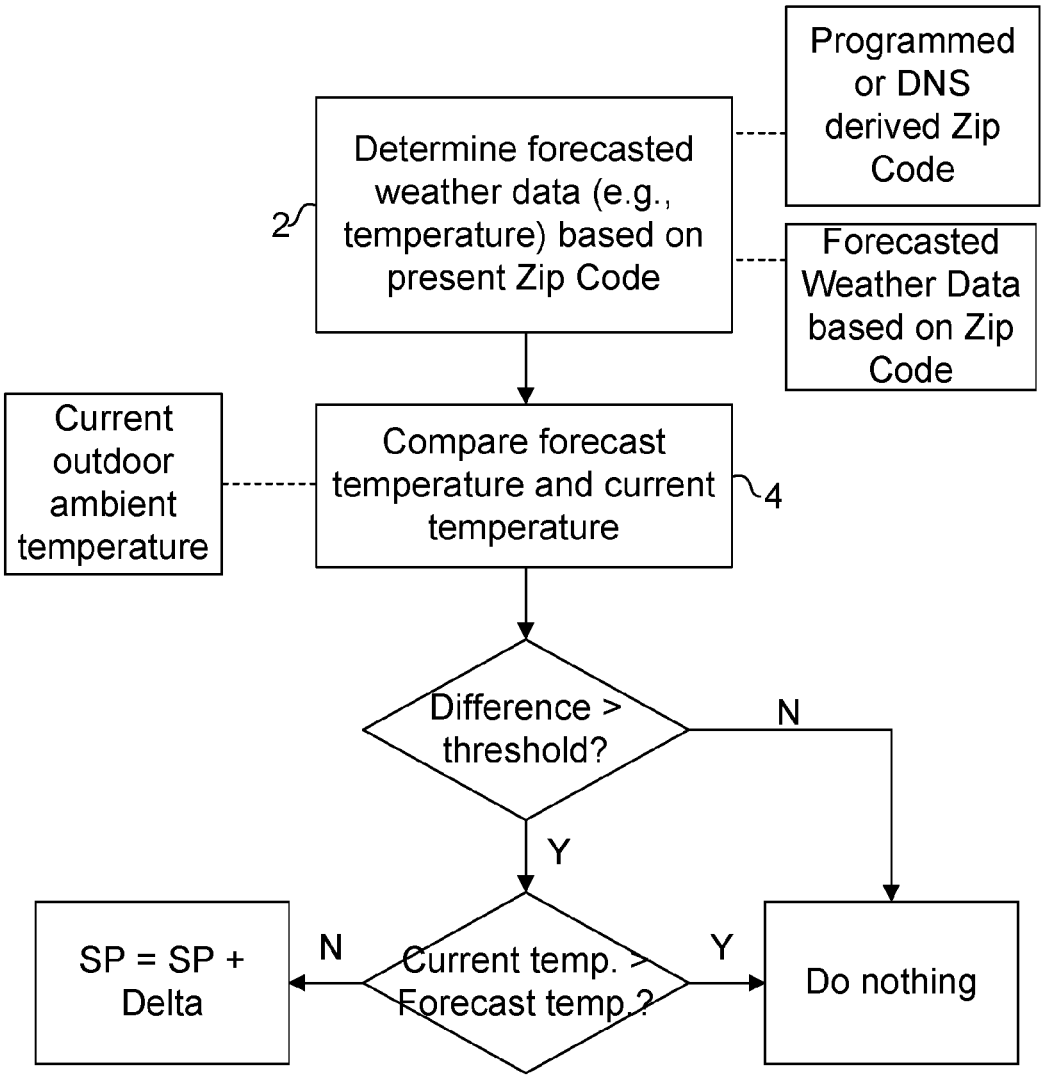
FIG. 1 is a diagram depicting a means by which the present weather forecast based control scheme is effected.

FIG. 1 is a diagram depicting a means by which the present weather forecast based control scheme is effected. There is provided a weather forecast-based water heating control system having at least one hot water delivery point, including a controller adapted to control a water supply to a setpoint temperature, a means for obtaining the forecasted air temperature at a future time at the location of the weather forecast based water heating control system and a means for obtaining the air temperature at a current time at the location of the weather forecast based water heating control system. The setpoint temperature of the water heater is adjusted by an adjustment amount if, when the forecasted air temperature at the location of the weather forecast based water heating control system is compared to the current air temperature at the location of the weather forecast based water heating control system as shown in step 4, the difference between exceeds a pre-determined threshold. Weather forecast data including such parameters as temperature, wind speed, cloud cover, wind chill factor, heat index, etc. can be made available from many sources for every location or zip code and updated hourly or sooner in many weather forecast services and communicated to the present control system via several means including, but not limited to, the internet, etc. In one embodiment, the difference between the future time and the current time is about an hour.

In determining the weather forecast data to retrieve as shown in step 2, a location of the water heating system must be determined. The zip code of the location of the water heating system may be manually entered into the water heater controller. Weather forecast data can be retrieved based on this manually entered zip code. The zip code may instead be programmed to be determined via a Domain Name Service (DNS) if the retrieval of weather forecast data is made via the internet. The latter eases the burden of an installer from having to set the zip code manually and correctly.

Figure 2:
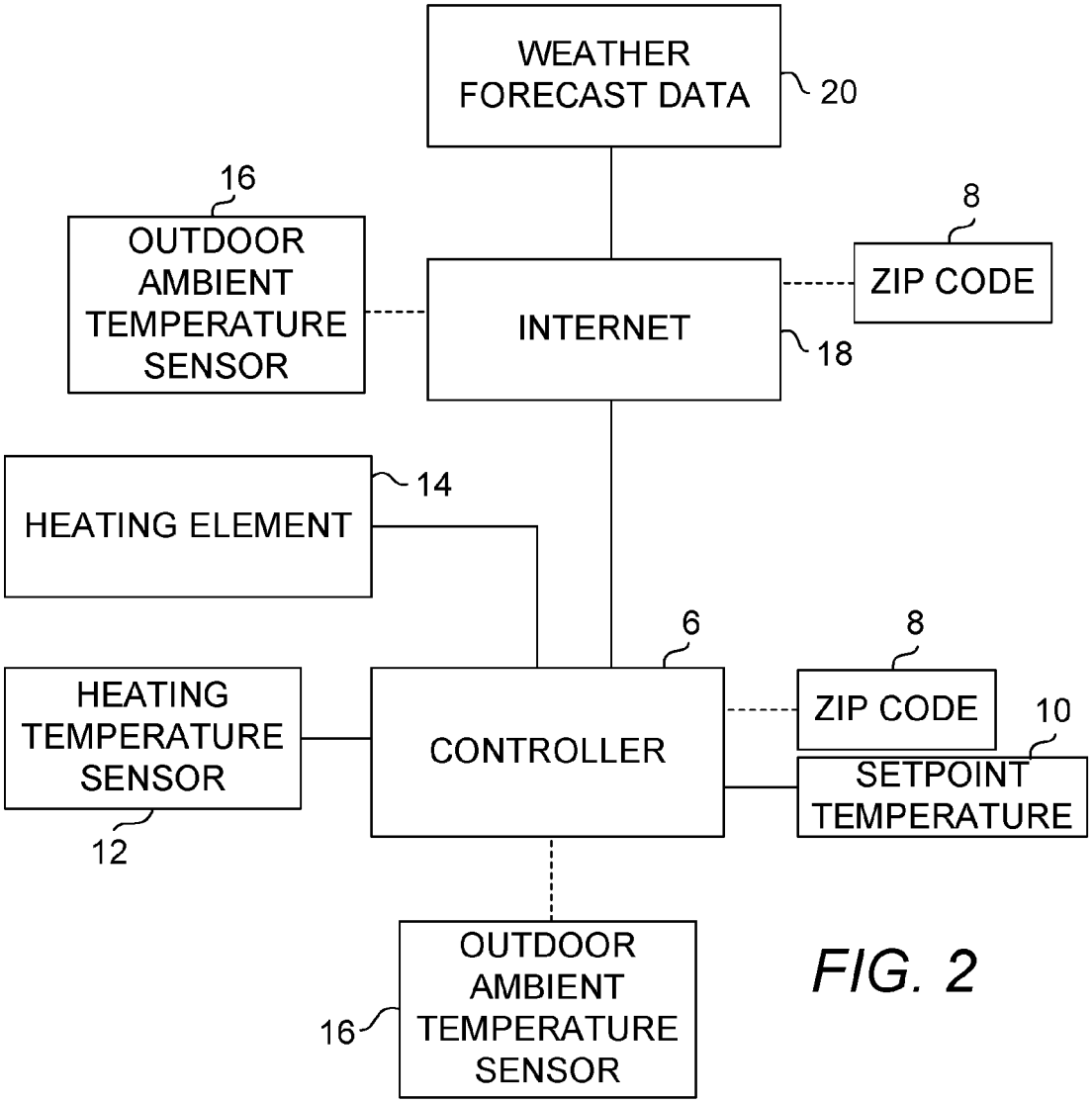
FIG. 2 is a diagram depicting a system enabling the present weather forecast based control scheme.

FIG. 2 is a diagram depicting a system enabling the present weather forecast based control scheme. A controller 6 can be adapted to receive a zip code input 8 manually set (e.g., as a zip code is entered locally via a keyboard) or automatically set by means of DNS via the internet 18 functionally connected to the controller. A setpoint temperature 10 can be manually set (e.g., entered locally via a keyboard at factory or locally) or automatically defaulted at build time to a default value, e.g., 120 degrees F. The controller 6 is configured to control a heating element 14 capable of heating a fluid to the setpoint temperature. A setpoint temperature is said to have been achieved when a temperature sensor reports an input 12 that matches this setpoint temperature.

A temperature sensor 16 configured to provide the outdoor ambient temperature can be provided locally and directly to the controller 6. This data can also be provided via the internet 18 individually or as a bundle with weather forecast data 20 which can include not only raw temperature data but also heat index and wind chill factor data.

Figure 3:
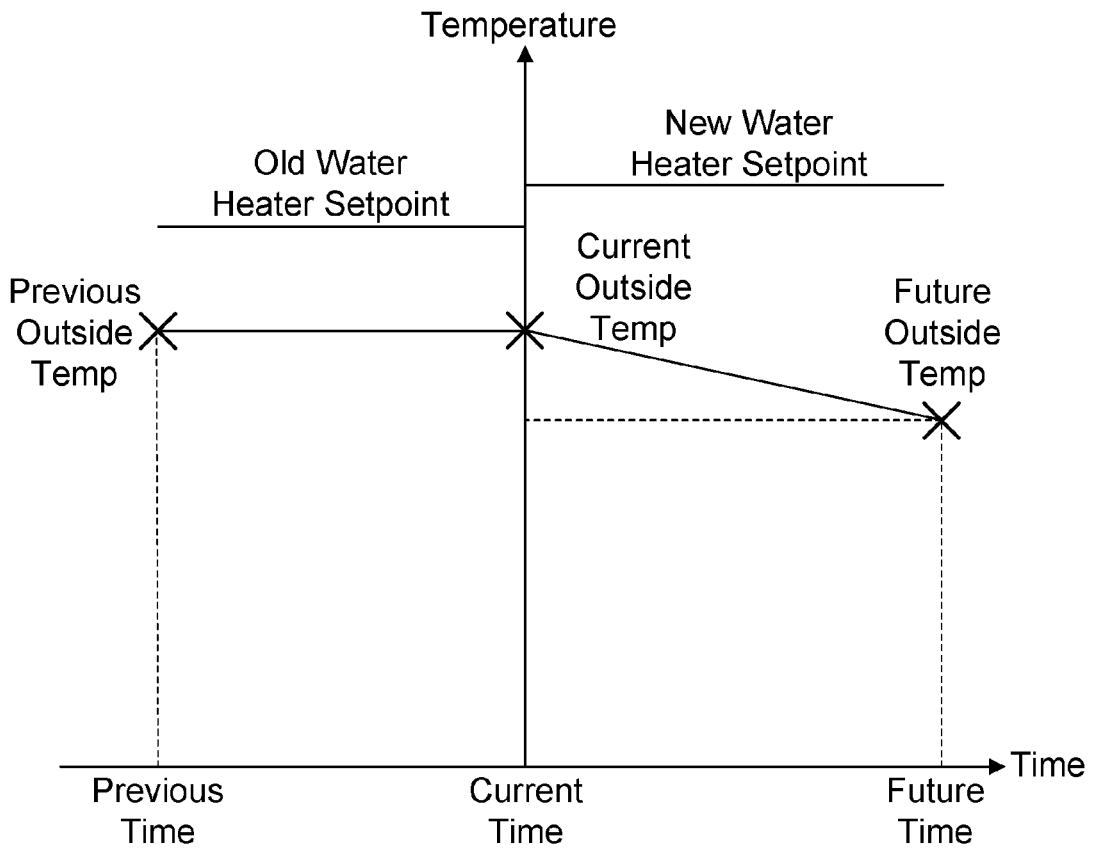
FIG. 3 is a diagram depicting one example in which the setpoint temperature of a water heater is set based on forecasted temperature.

FIG. 3 is a diagram depicting one example in which the setpoint temperature of a water heater is set based on forecasted temperature. In this example, the future outdoor temperature at a future time drops from the current outdoor temperature at the current time. A drop of the outdoor temperature can cause a user inside a building to feel cold as heat inside the building will be lost to the outdoors of the building at a greater rate. It may be true that, as the temperature of a space drops, a space heating system may add heat to replenish the lost heat until the temperature within the space has reached a level equivalent to the setpoint temperature of the space heating system. If the rate at which heat is lost to the outdoors is greater than the rate at which heat is replenished, it can take some time before the user feels comfortable again in the space being heated. Further, if pre-programmed space heating setpoints are used through a day, there is a chance that the space heating system is still struggling to meet a new higher setpoint when the outdoor temperature is dropping, causing a higher rate of heat loss. In order to make the user of a water heater feel more comfortable within a space, the setpoint temperature of a water heating system may be adjusted in a trend opposite that of the outdoor temperature. In other words, if the outdoor temperatures drops, the setpoint temperature of the heating system should be increased. The automatic adjustment of the water heating system setpoint temperature becomes particularly relevant when the user experiences events which cause the user to appreciate the increase in the setpoint temperature. For instance, an increase in the setpoint temperature is welcomed when the user has just experienced falling outdoor temperatures while the user was outside and wishes to take a hot shower. If the water heating control system is also used for space heating, such as in the case of a combined water heating and radiant floor heating system, the same adjustment made for the domestic water heating setpoint temperature can be applied to a radiant floor heating portion of the heating system. Conversely, if a user has just experienced a decreasing outdoor temperature, e.g., due to a warm front coming through the location, a return of the setpoint temperature to a lower normal temperature setpoint may be desirable. It is true that the user may choose to adjust the supply of hot water by adjusting the control knobs or levers of the faucets in mixing hot and cold water at the delivery point, however, the user typically has a pre-conceived temperature setting the user is accustomed to and does not typically like to deviate from the familiar control knob or lever settings.

The present control system allows the user to physically set the control knobs or levers to familiar settings but still experience comfortable water temperature at the familiar settings. In one example, if the forecasted outdoor temperature is more than an amount of discrepancy or pre-determined threshold in magnitude lower than the current outdoor temperature, the temperature setpoint is to be adjusted up by an adjustment amount and in any subsequent heating of the water supply, this new adjustment will be incorporated. In one embodiment, the amount of discrepancy is about 2 degrees F. for those that value comfort over energy savings. In another embodiment, the amount of discrepancy is about 5 degrees F. for those that can tolerate sudden temperature drop better. This amount of discrepancy is preferably end user-adjustable or at the very least adjustable at installation, based on preferences of the end users. In one embodiment, the adjustment is about one degree F. In another embodiment, the adjustment amount is about 2 degrees F. However, there is a limit to which the setpoint temperature may be adjusted to. For instance, if the normal setpoint is 120 degrees F. The maximum setpoint temperature may be about 126 degrees F. and the minimum setpoint temperature may be about 114 degrees F.

In some floor or space heating systems, an anti-freeze substance, e.g., Propylene Glycol, may be used and the floor or space heating systems may not be integral to water heating systems. In such cases, the floor or space heating systems may take identical or similar setpoint temperature adjustment outputs from the controllers of their corresponding water heating systems, although the magnitude of setpoint temperature adjustments may be different from the corresponding water heating systems.

In tank-type applications, the present control system aids in getting the temperature of the water reserve to a new setpoint temperature, especially when the setpoint temperature of the reserve needs to be increased. In certain circumstances, setpoints may be momentarily set even higher than those required new higher setpoints to further elevate the temperature of portions of the reserve that has been brought to a previously lower setpoint temperature. In on-demand water heating systems, as hot water is prepared based on a new demand, this demand may only occur after a great deal of time has elapsed or a new demand may not occur for this new setpoint at all. In tank-type applications, a new setpoint may be readily and immediately applied as soon as it has been determined, as the reserve that has been heated to the previous setpoint temperature or the reserve that is being heated to the new setpoint temperature, must be used before new water is further drawn into the tank.

In another embodiment, the wind chill factor and/or heat index are used instead of or in addition to the outdoor temperature to determine whether a water heater setpoint temperature adjustment is necessary. Wind chill factor is the perceived decrease in air temperature felt by the body on exposed skin due to the flow of air. When the apparent temperature is higher than the air temperature, the heat index may be used instead. According to National Digital Forecast Database, the apparent temperature is defined as the perceived temperature in degrees F. derived from either a combination of temperature and wind (or wind chill) or temperature and humidity (or heat index) for the indicated hour. When the temperature at a particular grid point falls to 50 degrees F. or less, wind chill will be used for that point for the apparent temperature. When the temperature at a grid point rises above 80 degrees F., the heat index will be used for apparent temperature. Between 51 and 80 degrees F., the apparent temperature will be the ambient air temperature.

If wind chill factor and heat index are considered, a parameter, e.g., P, incorporating the the outdoor temperature, the wind chill factor, the heat index and weighting factors for each may be used. For example $P=K1*T+K2*WCF+K3*HI$ where T is outdoor temperature, WCF is wind chill factor, HI is the heat index, K1 is the weighting factor for T, K2 is the weighting factor for WCF and K3 is the weighting factor for HI. Any one of parameters T, WCF and HI may be omitted from the computation of P although using all three will provide increased comfort to the users. Therefore in using the P instead of the outdoor temperature alone, a P value is calculated for the future conditions and a P value is calculated for the current conditions. The results are compared and if the difference exceeds a pre-determined value, an adjustment to the setpoint temperature of the water heating control system is made. Forecasted and current wind chill factor (a function of wind speed and temperature) and heat index (a function of temperature and dew point temperature or humidity) are preferably obtained via forecasted data package although it is also possible to obtain such parameters locally with additional equipment, e.g., wind meter for obtaining wind speed and psychrometer or hygrometer for obtaining humidity or dew point. It shall be noted that individual components, e.g., differences of K1*T, K2*WCF or K3*HI between the forecasted and current data may be first computed and summed up to arrive at the same result as the difference between the forecasted and current P.

The detailed description refers to the accompanying drawings that show, by way of illustration, specific aspects and embodiments in which the present disclosed embodiments may be practiced. These embodiments are described in sufficient detail to enable those skilled in the art to practice aspects of the present invention. Other embodiments may be utilized, and changes may be made without departing from the scope of the disclosed embodiments. The various embodiments can be combined with one or more other embodiments to form new embodiments. The detailed description is, therefore, not to be taken in a limiting sense, and the scope of the present invention is defined only by the appended claims, with the full scope of equivalents to which they may be entitled. It will be appreciated by those of ordinary skill in the art that any arrangement that is calculated to achieve the same purpose may be substituted for the specific embodiments shown. This application is intended to cover any adaptations or variations of embodiments of the present invention. It is to be understood that the above description is intended to be illustrative, and not restrictive, and that the phraseology or terminology employed herein is for the purpose of description and not of limitation. Combinations of the above embodiments and other embodiments will be apparent to those of skill in the art upon studying the above description. The scope of the present disclosed embodiments includes any other applications in which embodiments of the above structures and fabrication methods are used. The scope of the embodiments should be determined with reference to the appended claims, along with the full scope of equivalents to which such claims are entitled.

What is claimed herein is:

1. A domestic water heating control system having at least one hot fluid delivery point disposed at a location, said domestic water heating control system comprising:

(a) a controller adapted to control said domestic water heating control system to a setpoint temperature of the at least one hot fluid delivery point;

(b) a means for obtaining a forecasted outdoor air temperature at a future time at the location of said domestic water heating control system; and (c) a means for obtaining a current outdoor air temperature at a current time at the location of said domestic water heating control system, whereby the setpoint temperature of said at least one hot fluid delivery point is configured to be adjusted by an adjustment amount if the difference between the forecasted outdoor air temperature at the future time at the location of said domestic water heating control system and the current outdoor air temperature at the current time at the location of said domestic water heating control system exceeds a predetermined threshold.

2. The domestic water heating control system of claim 1, wherein said pre-determined threshold is a value selected from the group consisting of about 2 degrees F. and about 5 degrees F.

3. The domestic water heating control system of claim 1, wherein the difference between said future time and the current time is about one hour.

4. The domestic water heating control system of claim 1, wherein said adjustment amount is a value selected from the group consisting of about 1 degree F. and 2 degrees F.

5. The domestic water heating control system of claim 1, further comprising a means for obtaining a forecasted wind chill factor at a future time at the location of said domestic water heating control system and a means for obtaining a current wind chill factor at a current time at the location of said domestic water heating control system, wherein a difference of said forecasted wind chill factor and said current wind chill factor is configured to be applied to the adjustment of the setpoint temperature of said at least one hot fluid delivery point.

6. The domestic water heating control system of claim 1, further comprising a means for obtaining a forecasted heat index at a future time at the location of said domestic water heating control system and a means for obtaining a current heat index at a current time at the location of said domestic water heating control system, wherein a difference of said forecasted heat index and said current heat index is configured to be applied to the adjustment of the setpoint temperature of said at least one hot fluid delivery point.

7. A domestic water heating control system having at least one hot fluid delivery point disposed at a location, comprising:

(a) a controller adapted to control said domestic water heating control system to a setpoint temperature of the at least one hot fluid delivery point;

(b) a means for obtaining and comparing forecasted outdoor air temperature at a future time at the location of said domestic water heating control system and a current outdoor air temperature at a current time at the location of said domestic water heating control system to result in a first difference;

(c) a means for obtaining and comparing a forecasted wind chill factor at a future time at the location of said domestic water heating control system and a current wind chill factor at a current time at the location of said domestic water heating control system to result in a second difference; and (d) a means for obtaining and comparing a forecasted heat index at a future time at the location of said domestic water heating control system and a current heat index at a current time at the location of said domestic water heating control system to result in a third difference, wherein a sum of said first difference, said second difference and said third difference is configured to be calculated and whereby, if said sum exceeds a predetermined threshold, the setpoint temperature of said at least one hot fluid delivery point is configured to be adjusted by an adjustment amount.

8. The domestic water heating control system of claim 7, wherein each of said first, second and third difference is configured to be weighted.

9. The domestic water heating control system of claim 7, wherein said pre-determined threshold is a value selected from the group consisting of about 2 degrees F. and about 5 degrees F.

10. The domestic water heating control system of claim 7, wherein the difference between said future time and said current time is about one hour.

11. The domestic water heating control system of claim 7, wherein said adjustment amount is a value selected from the group consisting of about 1 degree F. and 2 degrees F.

12. A heating control method of a domestic water heating system disposed at a location, said method comprising a step of comparing a forecasted outdoor air temperature at a future time at the location and a current outdoor air temperature at a current time at the location, whereby if the difference between the forecasted outdoor air temperature at the future time at the location and the current outdoor air temperature at the current time at the location exceeds a pre-determined threshold, the setpoint temperature of the domestic water heating system is configured to be adjusted by an adjustment amount.

13. The heating control method of claim 12, further comprising a step of comparing a forecasted wind chill factor at a future time at the location and a current wind chill factor at a current time at the location, wherein the difference between said forecasted wind chill factor at a future time at the location and said current wind chill factor at a current time at the location is configured to be applied to the adjustment of the setpoint temperature of the domestic water heating system.

14. The heating control method of claim 13, wherein the difference between said forecasted wind chill factor at a future time at the location and said current wind chill factor at a current time at the location is configured to be weighted.

15. The heating control method of claim 12, further comprising a step of comparing a forecasted heat index at a future time at the location and a current heat index at a current time at the location, wherein the difference between said forecasted heat index at a future time at the location and said current heat index at a current time at the location is configured to be applied to the adjustment of the setpoint temperature of the domestic water heating system.

16. The heating control method of claim 15, wherein the difference between said forecasted heat index at a future time at the location and said current heat index at a current time at the location is configured to be weighted.

17. The heating control method of claim 12, wherein said pre-determined threshold is a value selected from the group consisting of about 2 degrees F. and about 5 degrees F.

18. The heating control method of claim 12, wherein the difference between said future time and the current time is about one hour.

19. The heating control method of claim 12, wherein said adjustment amount is a value selected from the group consisting of about 1 degree F. and 2 degrees F.

* * * * *